United States Patent [19]

Ramberg

[11] 3,959,940

[45] June 1, 1976

[54] REINFORCING ASSEMBLY AND REINFORCED CONCRETE BUILDING WALLS

[76] Inventor: Lawrence R. Ramberg, 2125 S. Tonne Road, Arlington Heights, Ill. 60005

[22] Filed: Apr. 8, 1974

[21] Appl. No.: 458,991

Related U.S. Application Data

[63] Continuation-in-part of Ser. No. 324,316, Jan. 17, 1973, abandoned.

[52] U.S. Cl. ..... 52/348; 52/378; 52/448; 52/581; 52/585; 52/665; 52/741

[51] Int. Cl.[2] ..... E04B 1/16

[58] Field of Search ..... 52/656, 601, 378, 454, 52/348, 741, 665, 626, 349, 447, 448, 414, 664, 630, 687, 477, 585

[56] References Cited

UNITED STATES PATENTS

| | | | |
|---|---|---|---|
| 1,031,926 | 7/1912 | Hansbrough | 52/601 |
| 3,744,194 | 7/1973 | Ramberg | 52/378 |

*Primary Examiner*—Ernest R. Purser
*Assistant Examiner*—Robert Farber
*Attorney, Agent, or Firm*—Hume, Clement, Brinks, Willian, Olds & Cook, Ltd.

[57] ABSTRACT

An improved system for forming concrete walls and roofs, such as for one and two story dwellings. A prefabricated frame assembly is formed of a plurality of pheripheral frame sections. Each frame section includes peripheral frame members. The vertical members are J-shaped. The short legs of the J-shaped members support reinforcing rods and the long legs are adapted to support tie rods in the same horizontal plane as the reinforcing rods. Vertical reinforcing rods are secured to and across the first reinforcing rods, thereby to form an open reinforcing network. The frame members provide surfaces to which panel board may be secured. A plurality of the frame sections positioned, as on a slab, are connected to a frame assembly by short tie rods. An array of frame sections and frame assemblies, after paneling has been applied internally, provides a skeleton reinforcing network to which concrete may then be applied to form a reinforced concrete structure. The long legs of the J-shaped members of adjacent sections butt to serve as a single screed point for the concrete. An adjustable extension member facilitates forming the walls either six or eight inches thick, if desired in addition to the standard four inch thickness.

9 Claims, 8 Drawing Figures

REINFORCING ASSEMBLY AND REINFORCED CONCRETE BUILDING WALLS

This application is a continuation of application Ser. No. 324,316 filed Jan. 17, 1973, now abandoned.

This invention relates to improved frame assemblies for reinforcing a concrete structure, and to improved, prefabricated reinforcing frame sections which are easily erected on site into a frame assembly to which interior water-repellent paneling may be directly applied, and to which concrete, such as lightweight concrete, may be efficiently and quickly applied.

One of the known modes of providing exterior structural walls for buildings, such as homes, is to erect and form reinforced concrete walls. Because the load bearing characteristics of concrete itself is not usually sufficient to serve as a wall, it is necessary to embed reinforcing material in it. As such, reinforcing material, such as reinforcing rods or reinforcing wire mesh, must initially be mounted in some way, either temporarily to a support, or, for example, with the lower ends of long vertical reinforcing rods initially embedded in a slab for the building. In such cases, it is thereafter usually necessary to provide a temporary frame, as of wood, into which concrete is poured or sprayed to form a wall about the reinforcing rods, after which the temporary wood form is removed. If a temporary frame is omitted, and concrete is sprayed, as on a mesh form, very substantial quantities of the sprayed-on concrete are wasted.

In accordance with this invention, many of the disadvantages inherent in the usual methods of forming reinforced concrete walls and roofs, such as for one or two story dwellings, are minimized or avoided completely. Indeed, this invention provides frame sections and assemblies which are easily erected and which are easily secured to each other to form a skeleton assembly for reinforced concrete walls and roofs. The frame sections incorporate J-shaped vertical frame members which, when erected on site, provide convenient screed lines and easily connected joints. The L-shaped frame sections give enhanced strength at windows and doors after application of the concrete. The prefabricated frame sections of this invention are easily and quickly erected on site into assemblies and a unitary skeleton reinforcing assembly for entire walls and buildings, dramatically speeding the erection time of reinforced concrete structures.

Further objects, advantages, and features of this invention will become apparent from the following description and drawings, of which:

Figure 1:
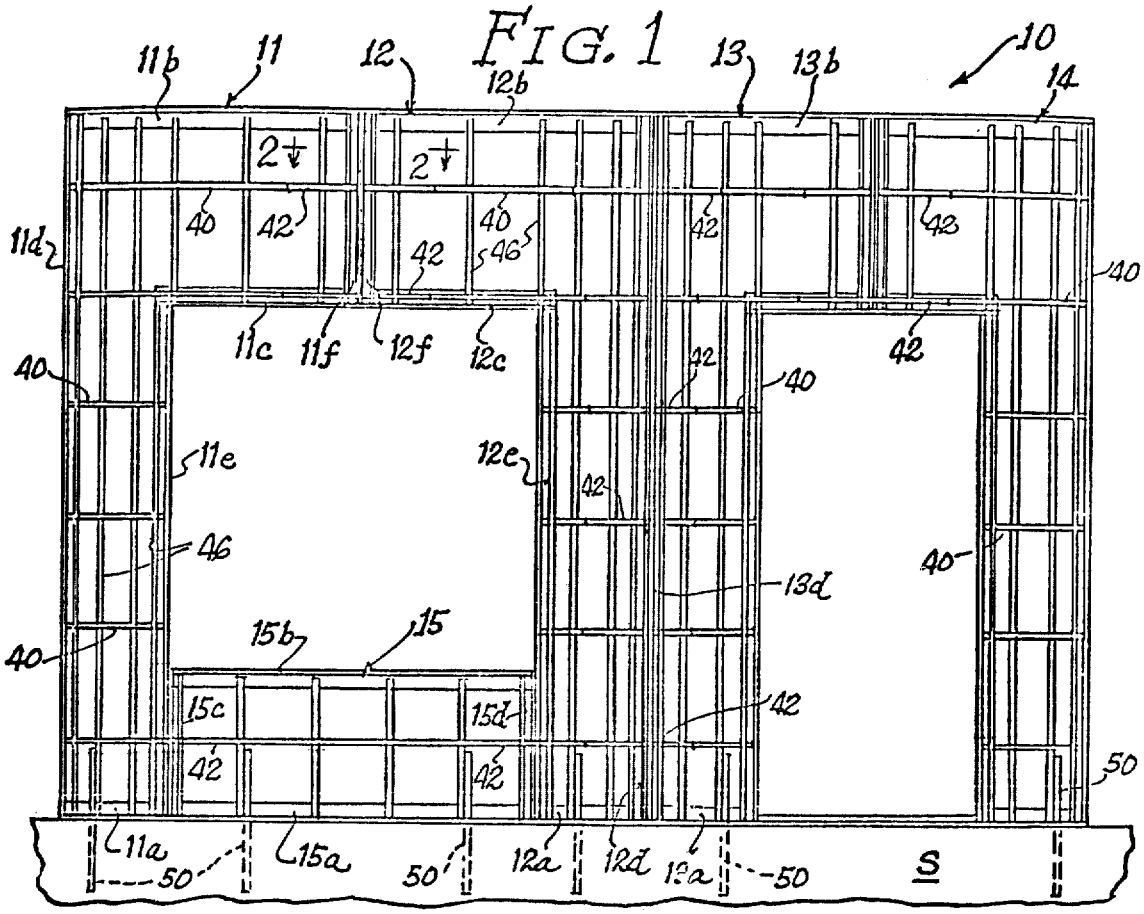
FIG. 1 illustrates a typical array or assembly of prefabricated frame sections of this invention to which concrete may be applied.

FIG. 1 illustrates a plurality of frame sections of this invention in a typical skeleton assembly array which might serve as a portion of a front wall of a one-story home. Frame assembly 10 is seen to comprise a plurality of generally co-planar frame sections 11, 12, 13, 14 and 15. Some of the frame sections are generally L-shaped, whereas others, such as section 15, are generally rectangular in peripheral outline. A typical frame section 11 comprises a plurality of elongate frame members, including a horizontal base member 11*a*, a horizontal header 11*b*, an intermediate horizontal member 11*c*, a vertical side member 11*d*, a second vertical side member 11*e*, and a third vertical side member 11*f*. These members are preferably secured together at their respective ends, as by tack welds, to form a rigid frame section 11. Similarly, frame section 12 comprises a series of tackwelded frame members 12*a*, 12*b*, 12*c*, 12*d*, 12*e* and 12*f*, L-shaped frame sections 13 and 14 include corresponding members. Frame section 15 is generally rectangular, and comprises a plurality of frame members icluding horizontal base member 15*a*, horizontal header 15*b*, and opposed spaced vertical members 15*c* and 15*d* which are approximately secured to each other as by tack welds to form rigid frame section 15.

So that cement, particularly sprayed cememt or concrete, will ultimately fill the channels and the frame sections, the horizontal frame members are desirably L-shaped, each having a single horizontal leg and a single vertical leg.

In accordance with this invention, the vertical frame members are J-shaped in end view. It has been found that such a shape, rather than the U-shape channel members of my prior application, provides a number of important advantages in the use of the frame sections, both in setting them up and installing them, as well as in their subsequent use.

Figure 2:
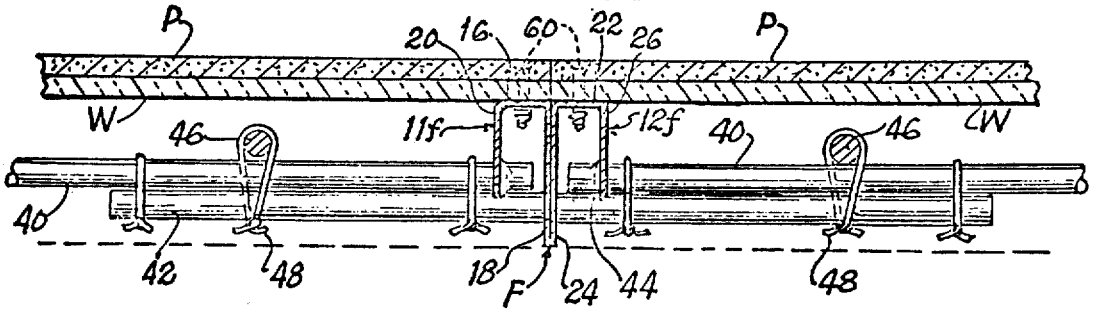
FIG. 2 is an enlarged cross-sectional view taken substantially along line 2—2 of FIG. 1.
Figure 4:
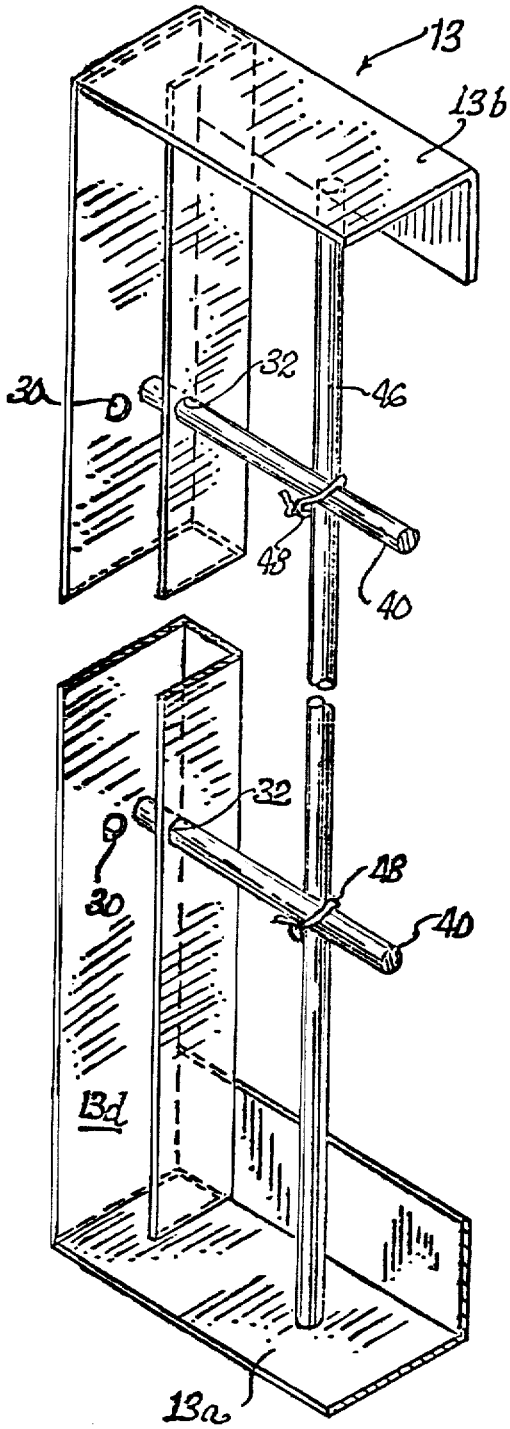
FIG. 4 is an enlarged, fragmentary perspective view of a frame section of FIG. 1.
Figure 5:
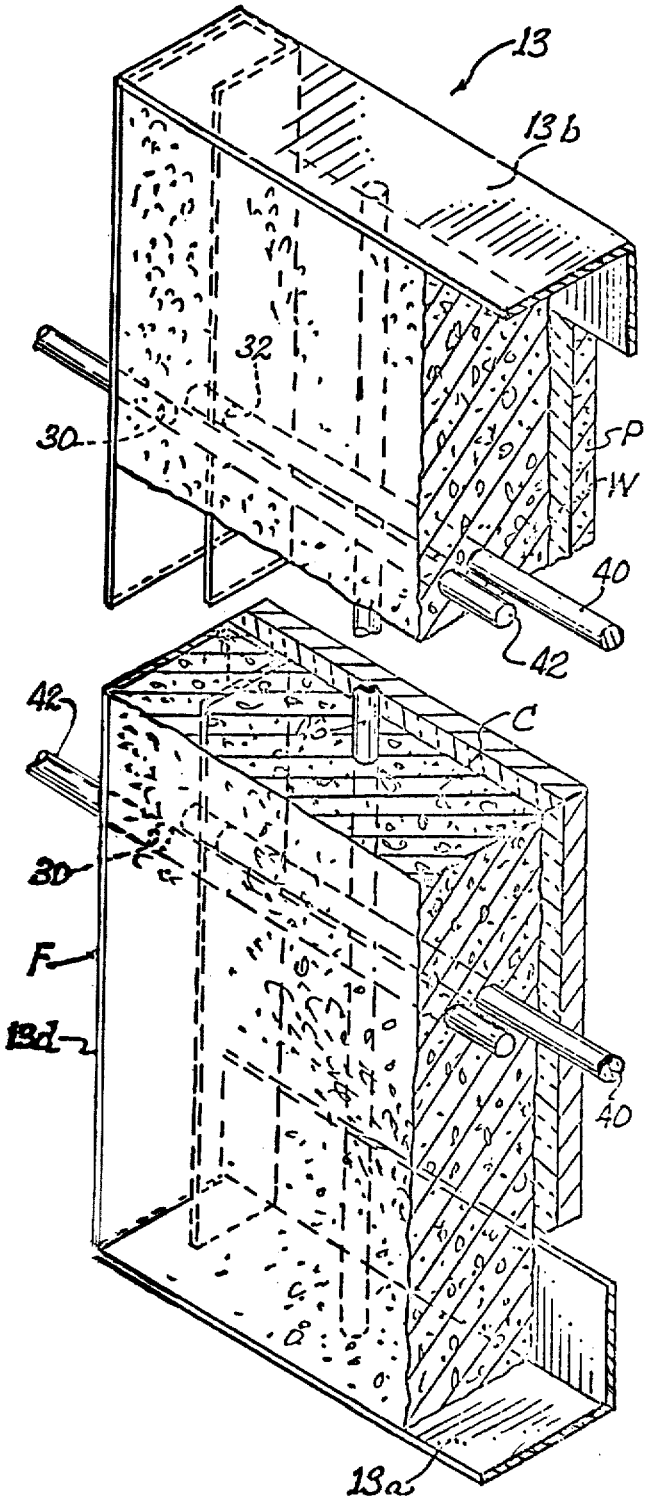
FIG. 5 is a view similar to FIG. 4 showing concrete applied to it.

Referring now to FIG. 2, a typical cross-section, frame members 11*f* and 12*f* are seen to be J-shaped and to have, respectively, central webs 16 and 22, long legs 18 and 24 and short legs 20 and 26. Each of the long legs 18 and 24 defines suitable vertically spaced apertures 30 for receiving and accommodating tie rods, whereas each of the short legs defines suitable vertically spaced apertures 32 for receiving the ends of reinforcing rods (see FIG. 4). Reinforcing rods 40 which span the space between opposed vertical J-shaped members, are provided in sufficient number to provide the strength characteristics desired of the particular frame section and frame assembly. To secure adjacent frame sections together, tie rods 42 are provided in apertures 30 horizontally adjacent rods 40. Tie rods 42 are easily positioned in apertures 30 and because apertures 30 and 32 are in different legs, it is possible, without unduly weakening the vertical frame members, to position the tie rods in the same horizontal plane as the reinforcing rods 40. When the sections are finally filled with concrete, the close horizontal adjacency of the reinforcing and tie rods 40 and 42 produces a wall structure of greater strength than those of prior art constructions.

As seen in the drawings, at least one elongate horizontal reinforcing rod 40, and depending upon the height of the unit, more than one reinforcing rod 40, spans the width of the frame sections between the confronting vertical members. The ends of the reinforcing rods 26 are preferably secured at the openings 32 as by nuts 44.

The vertical members may provide openings 30 and 32 which are as much as ¾ inch in diameter, thereby to accommodate, as desired, reinforcing and tie rods having diameters ranging from approximately ¼ inch to ¾ inch, depending upon the strength required from the reinforcing frame assembly to be embedded in the particular concrete structure. It has also been found desirable to form the frame members from 20-gauge black iron into channels having dimensions of between about 2 and about 3 or 4 inches, although, of course, other dimensions and materials may also be used.

To form the frame sections 11, 12, 13, 14 and 15, their vertical and horizontal members are laid out and are then secured to each other, as by tack welding. Thereafter reinforcing rods 40 are slid through the openings 32 in the short legs, the legs 22 of the confronting vertical members. The reinforcing rods 40 are somewhat shorter than the full width of the frame section between the vertical members so that the ends of the reinforcing rods 40 lie between the long legs at each side of the frame sections.

After the reinforcing rods 40 are secured in position, as by nuts 44, at least one second elongate reinforcing rod, such as a vertical reinforcing rod 46, is positioned perpendicularly to rods 40, as illustrated in the drawings. Desirably, they are secured to the horizontal reinforcing rods 40, as by tying them together with tie wires 48, or the like. As such, the vertical reinforcing rods 46 cross and are secured to the reinforcing rods 26 and, together with frame section members and the reinforcing rods 40, define an opening reinforcing network. Desirably, each frame assembly incorporates at least three reinforcing rods. It will be seen that the ends of the second reinforcing rods 46 also lie within the outer periphery defined by the members of the associated peripheral frame section.

The frame sections necessary to form a desired frame assembly 10 may be prefabricated, as in a factory, from which they are transported to a construction site for erection.

As illustrated in FIG. 1, a typical use of prefabricated frame sections, such as those forming assembly 10, would be to erect them on a pre-formed concrete slab S. A frame assembly, such as assembly 10 consisting of a plurality of sections 11–15 is positioned and mounted on a slab S in a predetermined location on the slab. The location may be predetermined, as by a series of short reinforcing rods 50, each having one end embedded in the slab and the other end projecting upwardly. Rods 50 are spaced and located to enter appropriate locating apertures in the horizontal base members of the frame sections. If such rods are used, they will serve, subsequently, to help tie the entire reinforced concrete structure to the slab.

The frame assembly array illustrated in FIG. 1 provides openings for, for example, a door and windows. Other frame assemblies may provide for solid walls. Further, it is preferable that each pair of frame sections, wherever possible, be connected by at least two tie rods 42.

Once an assembly, such as the front wall assembly illustrated in FIG. 1, has been erected, it may be combined with other assemblies for sidewalls, back walls, roofs and the like, which may be secured to each other and to the slab as appropriate. Indeed, the corners formed at intersecting walls tend to stabilize an entire peripheral exterior wall assembly to eliminate the need for supports to maintain the vertical assemblies in their vertical position during spraying of the concrete. Roof frame assemblies can be directly secured to the upper edges of vertical frame assemblies to form a complete wall and roof network for a home to which concrete may be applied at one time.

To complete a suitable skeleton array, the interior of the erected frame assemblies is covered, as with water repellent paneling, such as waterproof or water repellent plasterboard. This may then serve as a final interior wall surface for the reinforced concrete structural member. Where desired, insulation may also be provided.

To that end, in the embodiment illustrated, panel board P is secured with an insulation panel W by suitable fasteners 60 to support surfaces provided by legs of the frame members. Fasteners 60 pass through the paneling P and W and into the frame member legs, as illustrated by FIG. 2.

After paneling and insulation have been suitably mounted to the frame sections, the assembly is ready for the application of concrete, such as sprayable lightweight concrete. The panel boards P (which may serve to provide either a finished interior wall, or one which may be subsequently finished with plaster), serve as a backing for the skeleton frame assembly omitting the necessity for temporary forms, or the like. When concrete C is sprayed from the exterior surface, it forms against the paneling P (or panel W if insulation paneling is present) and about each of the frame members, sections and assemblies. The use of L-shaped horizontal members facilitates filling the frame assemblies with concrete completely.

Figure 3:
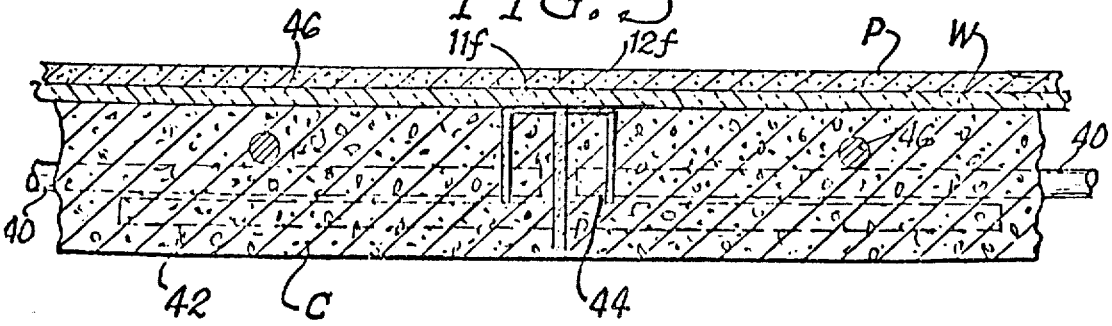
FIG. 3 is a view similar to FIG. 2, to which concrete has been applied.

It may be seen that the use of J-shaped vertical members, such as members 18 and 24, when butted, as seen in FIGS. 2 and 3, produces only one projection F per joint beyond the reinforcing rods and to the surface of the concrete. In my prior application, pairs of butting U-shaped channels produced three projecting channel edges per joint, exposing more metal at the surface and making it more difficult to provide a uniform outer surface after the concrete C was sprayed onto the frame assembly. Indeed, the single projection F per joint provides a most useful screed point for the sprayed concrete. Further, because the frame sections are tied together by short tie rods 42, the entire structure is formed into a strongly reinforced unitary structure. That provides very strong wall sections, or roof sections, or entire building shells quickly and efficiently, and with a minimum of waste of concrete.

Figure 7:
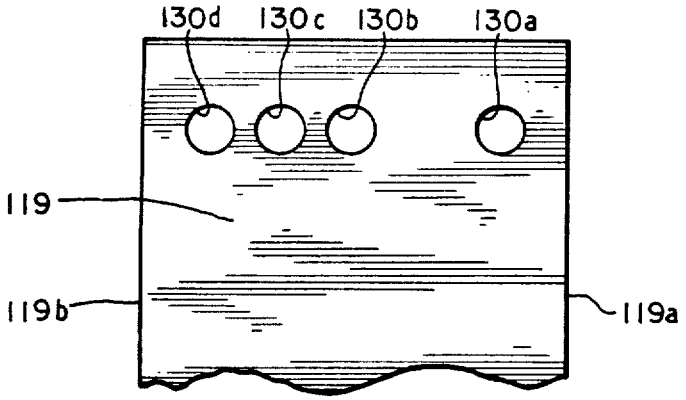
FIG. 7 is a front elevational view of an extension frame member utilized in the modified form of frame assembly, with part broken away.
Figure 6:
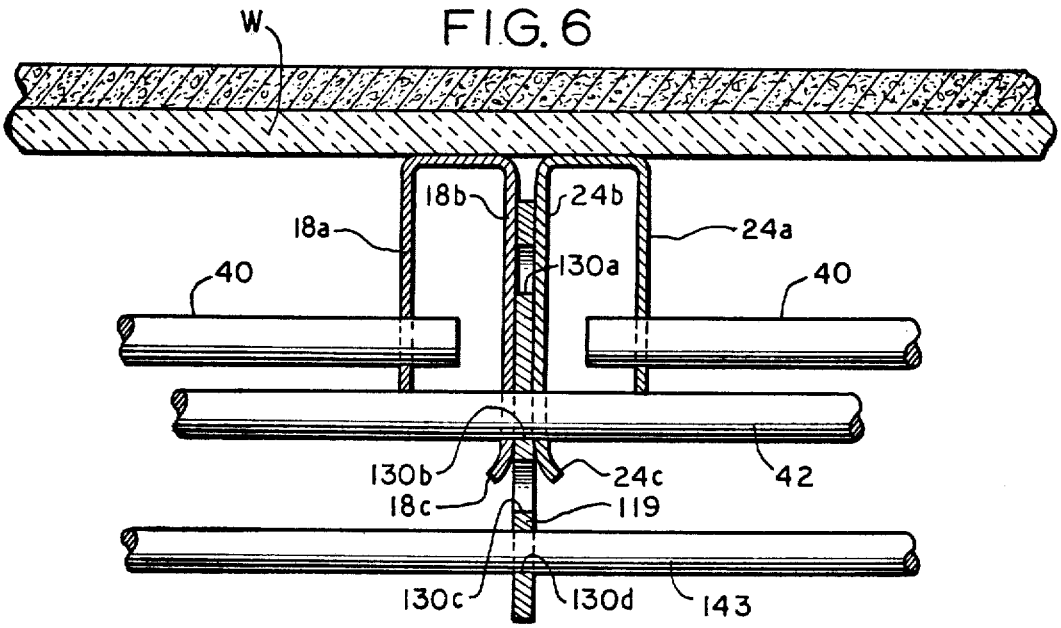
FIG. 6 is a cross-sectional view, similar to FIG. 2, illustrating a modified form of frame assembly embodying features of the present invention.

Referring now to FIG. 6, a modified form of the frame assembly 10 is illustrated which permits a wall to be constructed with either a standard 4 inch thickness, a 6 inch thickness, or an 8 inch thickness, the latter two being especially for below-grade or retaining walls. This is accomplished by employing an extension frame member 119 in the construction of the frame assembly 10. An extension frame member 119 is illustrated in side elevation in FIG. 7 with the major portion of it broken away.

The extension frame member 119 is, in fact, an elongated strip of 20-gauge black iron sheet having an inside edge 119*a* and an outside edge 119*b*. The length of the member 119 varies with the height of abutting frame sections 11 and 12, for example, being substantially the same as this height. According to the invention, the width of the extension member 119; i.e., the distance between the inner edge 119*a* and outer edge 119*b* of the member, is 6 inches.

The strip frame member 119 has, at uniformly spaced positions along its vertical length, groups of four horizontally spaced apertures 130*a*, 130*b*, 130*c* and 130*d*. Only one set of these horizontally spaced apertures 130*a*–130*d* is shown, adjacent the upper end of the strip member 119.

The three apertures 130*a*–130*c* are evenly spaced transversely of the plate 119, starting from adjacent the inner edge 119*a*, as will be recognized, while the aperture 130*d* is spaced a greater distance from the aperture 130*c* and positioned adjacent the outer edge 119*b* of the plate. According to the invention, the aperture 130*a* is centered 1 inch from the inside edge 119*a*, the aperture 130*b* 3 inches therefrom, the aperture 130*c* 4 inches and the aperture 130*d* 5 inches. The sets of apertures are spaced vertically at a distance of approximately 1½ feet to accommodate reinforcing and tie bars in a manner hereinafter discussed.

The manner in which an extension frame member 119 is incorporated in a frame assembly 10 to provide a wall 6 inches thick is illustrated in section in FIG. 6. As previously described, the frame assembly 10 includes a plurality of frame members 18 and 24 which are generally J-shaped in end view. The frame members 18 and 24 each have a corresponding shorter leg 18*a* and 24*a*, and corresponding longer legs 18*b* and 24*b*. According to the modified form of the assembly 10 embodying features of the invention, a ½ inch segment at the free ends 18*c* and 24*c* of the long legs 18*b* and 24*b*, respectively, is bent in the manner illustrated, to a point where it is offset ⅜ of an inch from the plane of the longer leg in question.

It will be observed that the frame members 18 and 24 are disposed in vertical pairs against insulation paneling W along the length of the frame assembly 10, with each long leg 18*b* and 24*b* of each pair in spaced, opposed relationship. Thus, the long leg 18*b* of frame member 18 faces the long leg 24*b* of the frame member 24. An extension member 119 is disposed in the space between the longer legs 18*b* and 24*b* of each pair of frame members 18 and 24, respectively. The outer edge 119*b* of the member protrudes 2 inches beyond the flared edges 18*c* and 24*c* of the longer legs 18*b* and 24*b*. In this position, elongated tie rods 42 can be inserted through the frame members 18 and 24 and through the extension member apertures 130*b*.

The apertures 130*d* adjacent the outer edge 119*b* of the extension member 119 receive parallel tie rods 143. In addition, as hereinbefore discussed in relation to the embodiment of the invention seen in FIGS. 1–5, the shorter legs 18*a* and 24*a* of the frame members 18 and 24 each have openings 32 therein adapted to receive reinforcing rods 40, which also extend parallel to the tying rod 42. It will thus be apparent that reinforcing rods 40 and 43, tie rods 40, frame members 18 and 24, and the extension member 119 cooperate in the frame assembly 10 to form an open, reinforcing network adapted to receive a quantity of concrete. The thickness of the concrete structural member formed by applying concrete to the frame assembly 10 is determined by the distance which the extension frame member protrudes from between the long legs 18*b* and 24*b*. This extension distance is, in turn, dictated by whether the tie rod 42 is passed through apertures 130*a* or 130*b* in the extension member 119.

By moving the extension member to a position where its outer edge 119*b* extends four inches from the edges 18*c* and 24*c*, a wall thickness of 8 inches is achieved. In this position, the tie rods 42 extend through the aperture 130*a* in the extension member 119.

Figure 8:
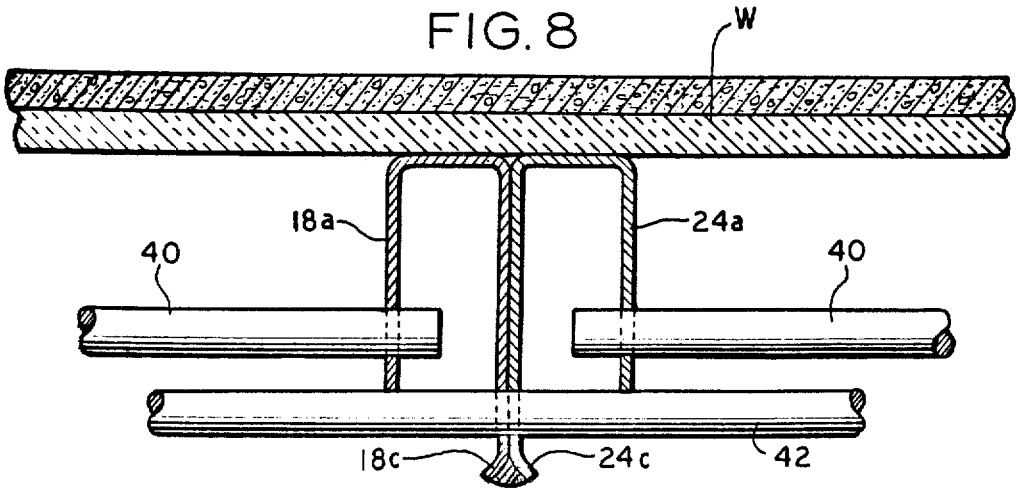
FIG. 8 is a cross-sectional view, similar to FIG. 6, illustrating the modified form of frame assembly seen in FIG. 6, with its extension frame member removed.

It is also possible to insert the extension member 119 fully between the legs 18 and 24 until its inner edge 119*b* is flush against the insulating board W. In such case, only approximately an inch of the outer edge 119*b* of the extension member 119 protrudes from the edges 18*c* and 24*c*, and the tie rods pass through the apertures 130*c*. This construction may be utilized to attach a "feature" strip to a 4 inch wall where the edge 119*b* protrudes, for example.

Where a normal, 4 inch thick concrete wall is being constructed according to the invention, these long legs 18*b* and 24*b* would be positioned flush against each other in the manner shown in FIG. 8 and hereinbefore described in relation to FIGS. 1–5. Concrete would be shotcreted on the walls to a point flush with the edges 18*c* and 24*c*. The V-shaped gap formed between these flared edges would then be filled with a suitable caulking compound to prevent moisture seepage between the wall segments.

When assembly of the frame units and extension members is made in the field, before the tie rods and reinforcing rods are all in place, the extension members 119 are temporarily secured to corresponding ones of the legs 18 and 24 with a suitable contact adhesive. As a result, they are easy to handle and do not fall out of position.

The L-shaped frame sections hereinbefore described are most effectively used at windows and doors. It was previously thought that use of a series of rectangular frame sections which serve to frame doors and windows, the peripheral edges of the rectangular frame sections being in line with the vertical edges of the window and door openings. However, it was determined that a stronger frame assembly is obtained when the frame sections are generally L-shaped and meet inwardly of the vertical edges of the windows and doors, as is clearly illustrated by FIG. 1.

Although rectangular and L-shaped frame assemblies have been illustrated, it will be apparent that frame assemblies having other external peripheral configurations may be used. For example, triangular frame assemblies may be formed, wherein first reinforcing rods are positioned in two opposite frame members, and second reinforcing rods are secured to the first reinforcing rods and cross the first reinforcing rods. Further, the frame assemblies may be flat coplanar assemblies, or may assume other shapes, such as a partispherical shape.

It will be apparent to those skilled in the art, from the foregoing description and drawings, that frame sections and assemblies, and skeleton arrays other than those specifically illustrated and described may be made within the spirit and scope of this invention. Accordingly, this invention is not to be considered as being limited by the foregoing specification and drawings, except insofar as is required by the appended claims.

I claim:

1. A skeleton frame assembly for forming a reinforced concrete structural member, said frame assembly comprising:

1. a pair of adjacent frame sections, each frame section comprising a plurality of elongate frame members secured together to define a periphery for said frame section, an opposed pair of vertical frame members being generally J-shaped in end view and each of the legs of the J-shaped members defining a plurality of spaced openings along its length, at least one first elongate reinforcing rod, each of said rods being disposed in an opening in the shorter of the legs, at least one end of each of said first reinforcing rods lying within the periphery of its frame section, and at least one second elongate reinforcing rod secured to and crossing said first reinforcing rods to define therewith and with said frame section an open reinforcing network, the ends of each of said second rods lying within the periphery of its frame section, said pair of frame sections having a long leg of a J-shaped member of each in butting engagement;
2. a plurality of short reinforcing rods in openings in adjacent ones of the long legs of said butting frame members, whereby when concrete is applied to said adjacent pair of frame sections, the frame sections are tied together by said short reinforcing rods.

2. A skeleton assembly in accordance with claim 1 wherein said short reinforcing rods lie in substantially the same horizontal plane as said first reinforcing rods.

3. A skeleton frame assembly in accordance with claim 1 to which concrete has been applied and with which said butting long legs have constituted a screed point.

4. A skeleton frame assembly in accordance with claim 1 in which said pair of adjacent frame sections each defines a generally L-shaped periphery, said frame sections being in butting engagement intermediate the vertical edges of a wall opening.

5. An open reinforcing network adapted to receive a quantity of concrete for producing a concrete structural member comprising:

a prefabricated frame section including a plurality of first frame members being generally J-shaped in end view, each of said frame members having a long leg, and a short leg having an opening therein; said first frame members being disposed in pairs along said frame section with said long leg of each of said pairs of said first frame members in spaced, facing relationship and adapted to receive therebetween a second frame member of any predetermined length, the length of said second frame member determining the thickness of said concrete structural member;

at least one first elongate reinforcing rod disposed in said opening in said short leg; and at least one second elongate reinforcing rod secured to and crossing said first reinforcing rod to define therewith, and with said frame section, said open reinforcing network.

6. The open reinforcing network set forth in claim 5 wherein said second frame members are disposed between each of said pairs of said first frame members and extend beyond the free end of said long legs of said first frame members, to increase the thickness of said concrete structural member.

7. The open reinforcing network set forth in claim 5 wherein the free ends of each of said long legs of said first frame members is flared.

8. The open reinforcing network set forth in claim 5 wherein said second frame member has a first opening near one end thereof, and wherein said reinforcing network includes at least one third elongate reinforcing rod disposed in said first opening in said second frame member.

9. The open reinforcing network set forth in claim 5 wherein said second frame member has a second opening alignable with said opening in said long leg of said first frame member, and wherein said open reinforcing network further includes at least one elongate tying rod disposed in said opening in said long leg of said first frame member and said second opening in said second frame member.

* * * * *